US009392848B2

(12) United States Patent
LeBlanc

(10) Patent No.: US 9,392,848 B2
(45) Date of Patent: Jul. 19, 2016

(54) MAGNETICALLY COUPLING ADORNMENT ASSEMBLY FOR IMPROVING AESTHETIC APPEAL OF AN ITEM

(71) Applicant: Magnum Opus, Inc., Castle Rock, CO (US)

(72) Inventor: Kimberly Marie LeBlanc, Castle Rock, CO (US)

(73) Assignee: Magnum Opus, Inc., Castle Rock, CO (US)

( * ) Notice: Subject to any disclaimer, the term of this patent is extended or adjusted under 35 U.S.C. 154(b) by 0 days.

(21) Appl. No.: 14/306,042

(22) Filed: Jun. 16, 2014

(65) Prior Publication Data

US 2014/0370229 A1 Dec. 18, 2014

Related U.S. Application Data

(60) Provisional application No. 61/956,831, filed on Jun. 18, 2013.

(51) Int. Cl.

| | |
|---|---|
| ***A44C 15/00*** | (2006.01) |
| ***A44C 1/00*** | (2006.01) |
| ***A44B 1/04*** | (2006.01) |

(52) U.S. Cl.

CPC ... *A44C 1/00* (2013.01); *A44B 1/04* (2013.01); *A44C 15/003* (2013.01); *A44D 2203/00* (2013.01); *Y10T 428/24008* (2015.01)

(58) Field of Classification Search

CPC ..... A44D 2203/00
USPC ..... 428/99, 900; 24/303
See application file for complete search history.

(56) References Cited

U.S. PATENT DOCUMENTS

| | | | | |
|---|---|---|---|---|
| 2,601,424 | A * | 6/1952 | Baker | A44B 6/00 24/303 |
| 2,690,025 | A | 9/1954 | Petty | |
| 2,935,662 | A | 5/1960 | Hausmann | |
| 3,416,195 | A | 12/1968 | Borthwick | |
| 4,505,007 | A | 3/1985 | Aoki | |
| 4,912,944 | A | 4/1990 | Crosley et al. | |
| 4,982,581 | A | 1/1991 | Furuyama | |
| 5,432,986 | A | 7/1995 | Sexton | |
| 5,517,722 | A | 5/1996 | Bender | |
| 5,740,557 | A | 4/1998 | Reid et al. | |
| 5,974,634 | A | 11/1999 | Eisenpresser | |
| 5,996,116 | A | 12/1999 | Tate | |

(Continued)

OTHER PUBLICATIONS

Unknown, Taillightz [online] Rainworks LLC, 2013 [retrieved on Jun. 3, 2014]. Retrieved from the internet: <URL: www.taillightz.com>, 2 pages.

(Continued)

*Primary Examiner* — Alexander Thomas
(74) *Attorney, Agent, or Firm* — Dorsey & Whitney LLP

(57) ABSTRACT

A magnetic adornment assembly for improving aesthetic appeal of an item, such as a personal or commercial item, consists of top and bottom members which can be reversibly magnetically coupled to one another. The personal or commercial item is placed between concentrically aligned top and bottom members such that magnetic attraction between the members is established, thereby securing the magnetic adornment assembly to the personal or commercial item. A decoration layer is provided on an outer viewable surface of the personal or commercial item and may be ornamental or informational.

21 Claims, 5 Drawing Sheets

(56) References Cited

U.S. PATENT DOCUMENTS

| | | | |
|---|---|---|---|
| 6,170,088 | B1 | 1/2001 | Tate |
| 6,170,131 | B1 | 1/2001 | Shin |
| 6,175,963 | B1 | 1/2001 | Loeffelholz |
| 6,282,760 | B1 | 9/2001 | Mars |
| 6,378,174 | B1 | 4/2002 | Wong |
| 6,671,986 | B2 | 1/2004 | Reeves |
| 6,715,315 | B1 | 4/2004 | Hartgrove |
| 7,356,882 | B1 | 4/2008 | Guadagno, IV et al. |
| 8,387,412 | B2 | 3/2013 | O'Byrne |
| 2007/0186390 | A1 | 8/2007 | Johnston |
| 2010/0005633 | A1* | 1/2010 | Nolet ..... H01F 7/0221 24/303 |
| 2010/0064484 | A1* | 3/2010 | Clark ..... A44C 17/0216 24/303 |
| 2011/0219587 | A1 | 9/2011 | Nizan et al. |

OTHER PUBLICATIONS

Unknown, "MagneButton", [online] MagneButton, 2011 [retrieved on Jun. 3, 2014]. Retrieved from the internet: <URL: https://magnebutton.com>.

* cited by examiner

10

100
20
10
13
23
25a
25
10

25a 25
10

10

10

MAGNETICALLY COUPLING ADORNMENT ASSEMBLY FOR IMPROVING AESTHETIC APPEAL OF AN ITEM

CROSS REFERENCE TO RELATED APPLICATIONS

This application claims the benefit of priority pursuant to 35 U.S.C. §119(e) of U.S. provisional application No. 61/956,831 filed 18 Jun. 2013 entitled "Magnetic assembly for adorning personal and commercial items," which is hereby incorporated herein by reference in its entirety.

TECHNICAL FIELD

The present invention relates generally to a magnetic adornment assembly for aesthetically improving an existing personal or commercial item by means of magnetic attachment of a decorative member to the personal or commercial item.

BACKGROUND

As discussed in more detail below, the present invention generally relates to improving the aesthetic appeal of personal or commercial items. With items such as clothing or accessories, it is common to keep such personal items for an extended period of time. Over time through normal wear and tear, the item eventually can develop unsightly or embarrassing tears, holes, or stains. Additionally, even when well taken care of, if fashion or personal interests change, the item may no longer reflect the user's individual personality or likes.

Ordinarily, when an item of clothing becomes incompatible with a person's interest or fashion, has developed a tear or stain, or otherwise is no longer desirable, the item would be discarded or stored away. If so desired, mending the item often required skilled attention such as by a person with sewing experience, or required expensive and difficult stain removal treatment to make the item usable again. Short of requiring physical mending, it is also common over time to accumulate several items which have logos or emblems printed or affixed on them, such as a logo for an employer, school, or sports team. As time passes and personal preferences or employment change, the item may still function normally but the user chooses not to utilize the item because of the outdated insignia. Accordingly, there is a need for an easy and low cost alternative to keep items in continued use and reduce the need to replace a damaged, worn, or outdated item.

The information included in this Background section of the specification, including any references cited herein and any description or discussion thereof, is included for technical reference purposes only and is not to be regarded subject matter by which the scope of the invention as defined in the claims is to be bound.

SUMMARY

The present disclosure therefore offers an inexpensive and easy alternative which allows a user to easily mend an imperfection or update an item to reflect new interests and fashion. In one embodiment, a magnetic adornment assembly may be used for an item such as clothing as a no-sew, easy, and effective alternative to manually repair an item, or to update and make it useable again. It is preferable to do so without further physically damaging the item, and accordingly as opposed to requiring pins which penetrate the item or stitches which require skilled attention, the magnetic adornment assembly allows for a removable, easily repositionable, interchangeable, and personally expressive solution to fix unwanted insignia or unsightly damage.

Other embodiments of the magnetic adornment assembly within the scope of the present disclosure may also be used to aesthetically enhance other items such as bags, backpacks, flip flops or other types of shoes, hats, pets, doll clothing, computer covers, or in professional situations such as an informational piece (e.g., a name badge or company affiliation). Alternatively, instead of a personal item, the adornment assembly may also be applied directly to a person (or animal) such as securing to a person's hair instead of a hair clip or barrette, thus acting as a unique, fashionable, and creative hair accessory. The magnetic adornment assembly according to some embodiments may also be used with commercial items such as display windows, workspaces, entrances, outdoor or indoor signage, and commercial or personal vehicles.

In one exemplary implementation, an apparatus for improving the aesthetic appeal of an item includes an outer assembly, an inner assembly, and a cover layer. The outer assembly may have a first magnetic engagement member and at least one decorative element. The inner assembly may have a second magnetic engagement member. The cover layer may be provided on the second magnetic engagement member and have a flange portion that extends beyond a perimeter of the second magnetic engagement member that is configured to be simultaneously grasped on opposing sides of the flange portion when the apparatus is coupled to the item. When the item is positioned between the outer assembly and inner assembly, the first magnetic engagement member is operable to attract the second magnetic engagement member, thereby reversibly coupling the outer assembly to the inner assembly.

The above examples are not meant to limit the scope or be an exhaustive list of applications, but are provided merely to illustrate the variety of uses and items which can be creatively and aesthetically enhanced using the magnetic adornment assembly of the present invention.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of the present invention as defined in the claims is provided in the following written description of various embodiments of the invention and illustrated in the accompanying drawings.

DETAILED DESCRIPTION

Figure 2:
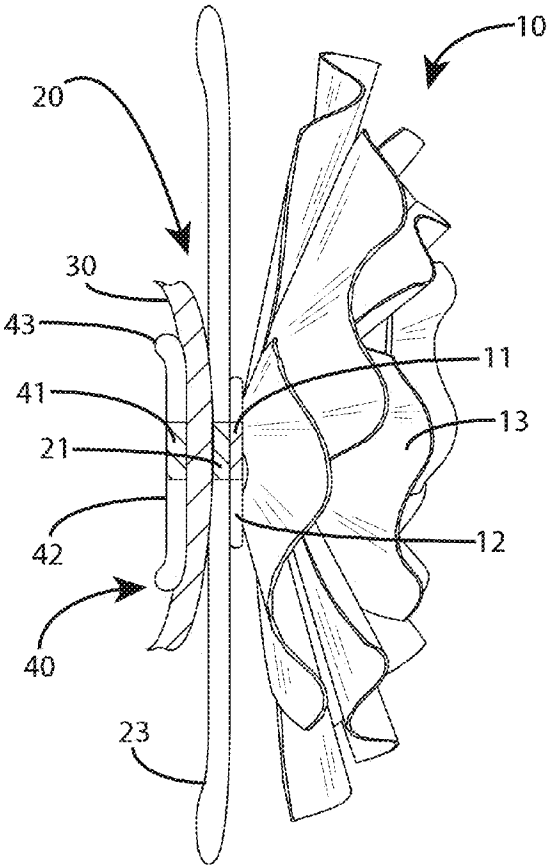
FIG. 2 is a cross-sectional view of the assembly of FIG. 1 with an optional intermediate member shown.
Figure 1:
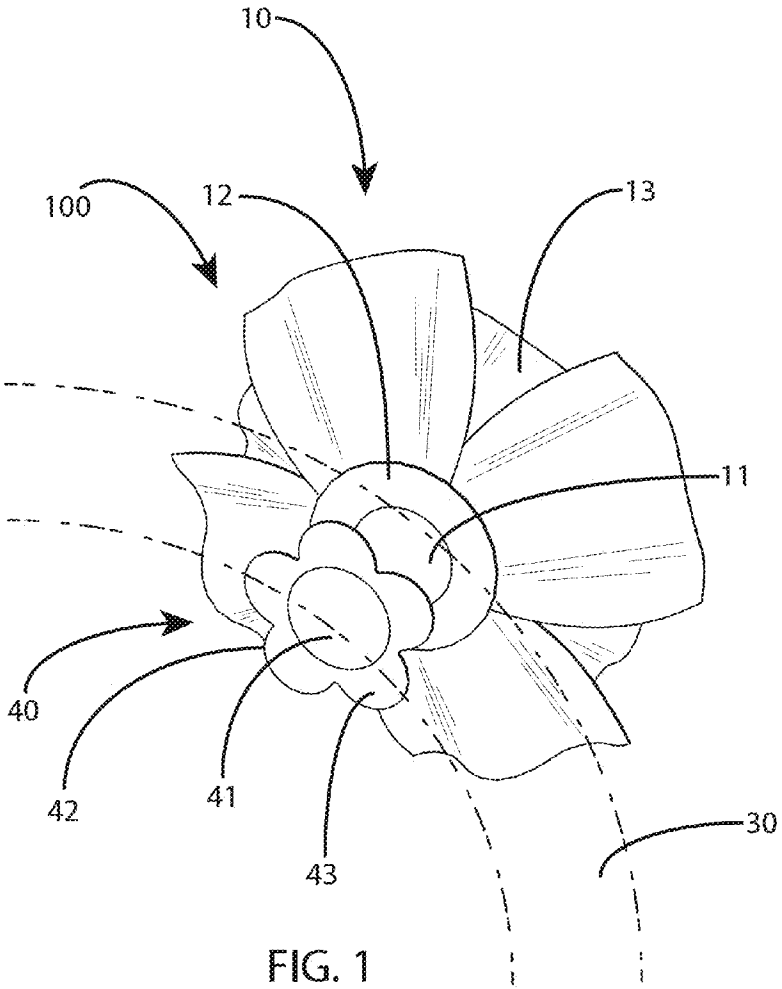
FIG. 1 is an isometric view of the magnetic adornment assembly as assembled according to one embodiment of the invention.
Figure 3:
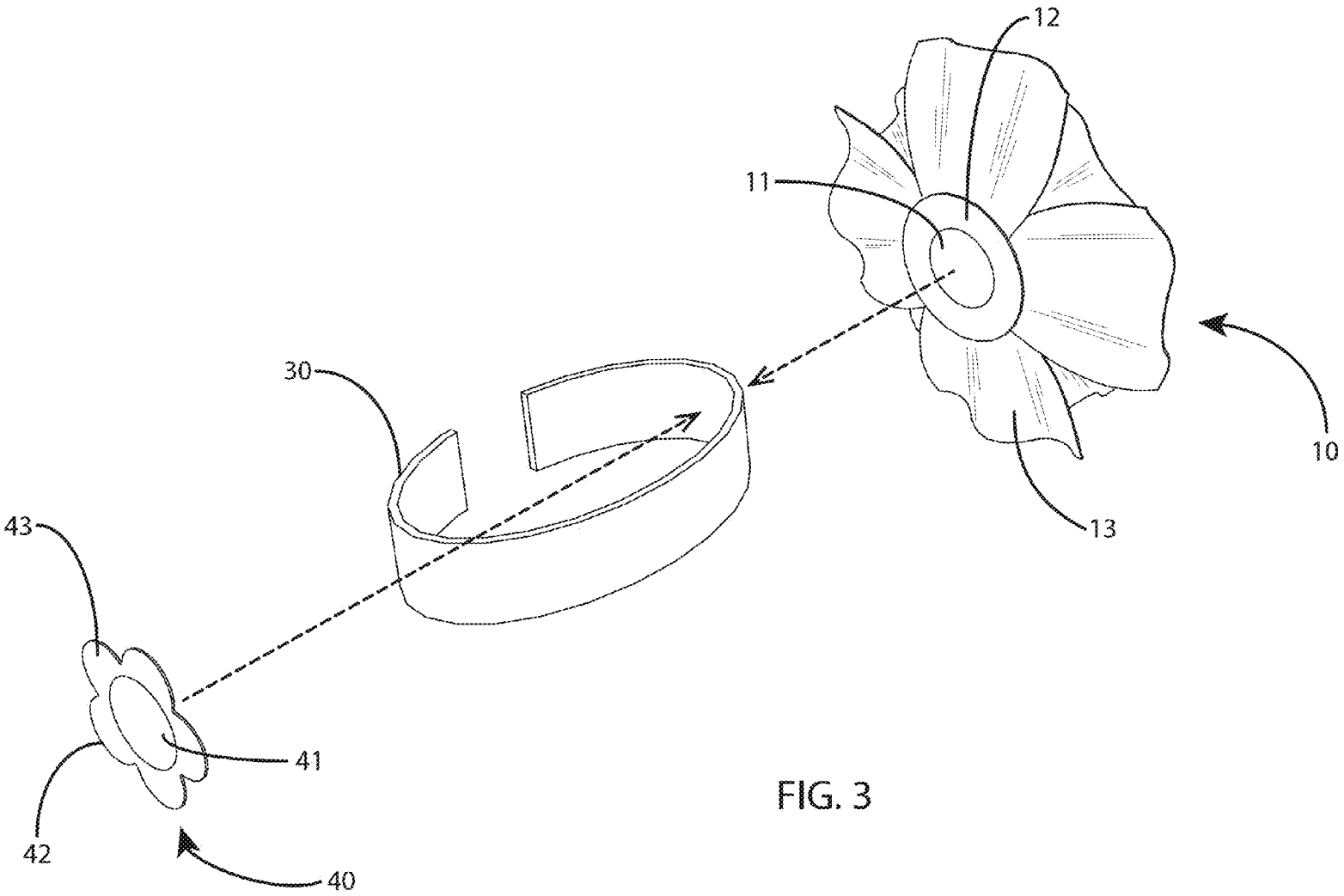
FIG. 3 is an exploded view of the magnetic adornment assembly depicted in FIG. 1.

As shown in FIGS. 1-3, the magnetic adornment assembly 100 consists of several constituent members. The ornamental top member 10 has a decoration layer 13 having a first engagement surface 12 on which a first magnetic member 11 is affixed. The first magnetic member 11 magnetically couples with a second magnetic member 41, which is formed as a part of a bottom member 40, with an item 30 selectively disposed between. Alternatively, the bottom member 40 consists of the first magnetic member.

In one exemplary embodiment, the first and/or second magnetic member may be a naturally occurring magnet. However, it is not limited to this and can be any type of magnet including neodymium, ceramic, ferrite, or alnico, or a temporary magnet such as a metallic surface which reacts to magnetism by temporarily exhibiting magnetic properties (e.g. a ferrous metal or other material capable of magnetic attraction). In such an embodiment where one of the first and second magnetic members is a temporary magnet (e.g. an iron plate or the like), the other of the first and second magnetic members is a non-temporary magnet such that mutual attraction between the two engagement members is attained. The materials or magnets used to effect the magnetic attraction are selected such that the attractive force is sufficiently strong to hold at least a minimum weight, including the weight of the magnet itself as well as the weight of any decoration layers, intermediate layers, or other attachments.

The first and second magnetic members can take on any shape to suit the particular purpose of the magnetic adornment assembly 100. The first and second magnetic members 11 and 41 can be rigid, flexible, semi-rigid, resilient, flat, or contoured. In one embodiment, the first and second magnetic members have a generally planar shape, with opposing surfaces substantially parallel and flat. Similarly, the engagement surface 12 of the top member 10 may generally match the shape of the magnetic members and therefore may also be generally planar in the area of contacting the magnetic member in order to efficiently and securely affix the first magnetic member 11 to the decoration layer 13. The first magnetic member may be affixed to the engagement surface 12 by any suitable means including stitches, adhesive, or may be made integral with the material of the engagement surface. It is noted however that a distinct engagement surface 12 is not necessary, and the top member 10 may be formed integrally with the first magnetic member 11 (i.e., by affixing the decoration layer 11 directly to the first magnetic member in any suitable manner).

As shown in FIG. 4, the decoration layer 13 may have any form independent of the shape of the first and second magnetic members 11 and 41. Since the decoration layer 13 is intended to be viewable from an exterior or outer side of an item 30, the decoration layer may be ornamental, decorative, and/or informational in nature. The decoration layer may be formed of any composition, may have substantially any two-dimensional or three-dimensional shape, and optionally be provided writing, images, company insignia, team affiliations, or other embellishments thereon. In some embodiments, as shown in FIGS. 1-4, decoration layer 13 may be formed in the general shape of a flower applied to an item such as a headband.

In any of the embodiments, the item 30 can be any suitable item such as a garment, accessory, bag, commercial item or surface, or any item of suitable thickness and composition to enable magnetic attraction therethrough. As shown in FIG. 3, in an exemplary embodiment the item 30 is placed between the top member 10 and the bottom member 40 when the magnetic adornment assembly 100 is assembled. The decoration layer 13 is viewable on the outside of the top member 10 and the first magnetic member 11 and second magnetic member 41 cooperatively interact to complete and secure the magnetic adornment assembly 100 to the item 30. The first and second magnetic members 11 and 41 may be similarly formed, or may be made of different materials and shapes, as long as the shape and composition is complimentary to allow for a secure magnetic coupling therebetween. In some embodiments, the first magnetic member 11 is a conventional or artificial magnet and the second magnetic member 41 is a metal material which reacts to attract a magnetic field. Alternatively the first magnetic member 11 is a magnetically attractive metal material and the second magnetic member 41 is a conventional or artificial magnet. In still other embodiments, both the first and second magnetic members 11 and 41 are conventional or artificial magnets.

The bottom member 40 is preferably low-profile so the user does not notice it when the assembly 100 is in use on a wearable item. The bottom member 40 may be also be advantageously sized and shaped to reduce the risk of it becoming a choking hazard for children when it is not in use or is otherwise unpaired with the top member 10. For example, the bottom member 40 may be sized to comply with certain regulations on the size of small parts such as the U.S. Consumer Product Safety Commission's guidelines on choking hazards for small children as set forth in the code of federal regulations at 16 C.F.R 1501. However, any appropriate guidelines for reducing choking risk may be used. In one example, the bottom member 40 may be sized so that it is 1.25 inches or greater in diameter. As shown in the Figures, the first and second magnetic members can be circular in shape. However, the magnetic members are not limited to this shape, and square, triangular, polygonal, or irregular magnetic members are within the scope of the present invention.

In some embodiments, the bottom member 40 is provided with a second magnetic member 41 which is provided with a cover layer 42 on at least one side of the magnetic member 41. In an exemplary embodiment as shown in FIGS. 1-3 and FIG. 5, the second magnetic member 41 is encapsulated by or laminated within the cover layer 42. The cover layer 42 can be provided with a gripping portion 43. The gripping portion 43 may be formed by a portion of the cover layer extending beyond the major physical dimension of the second magnetic member 41 (e.g., having a larger overall diameter). The cover layer 42 and/or the gripping portion 43 and can have a smooth surface which aids in removal of the assembly due to lower sliding friction, or can have textured features on at least a portion of the surface thereof. In some embodiments the textured features of the gripping portion 43 may be provided only around a perimeter of the cover layer 42, such as the portion which is outside the central portion 44. The gripping portion 43, or the cover layer 42 as a whole, may be formed of a material which has an appropriate friction coefficient to facilitate easy gripping by a user's fingers, and preferably by a simple pincer grasp.

Figure 5B:
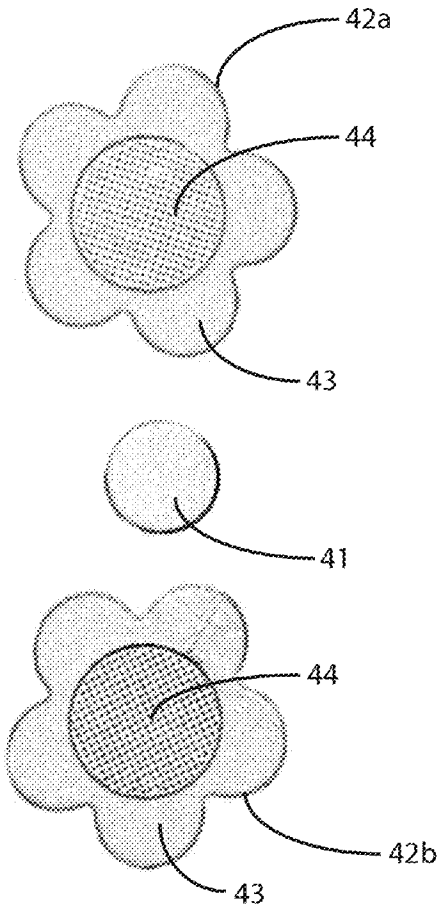
FIG. 5B shows the inner surface of two cover layers before introduction of a magnetic member.
Figure 5A:
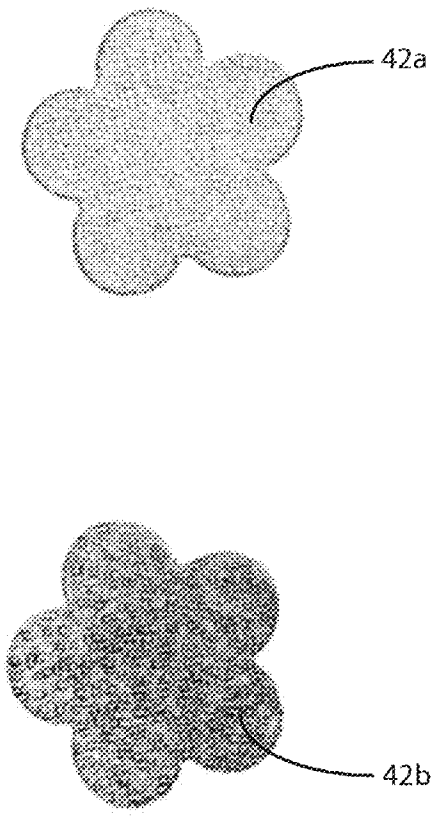
FIG. 5A shows an outer surface of two cover layers before introduction of a magnetic member.
Figure 5D:
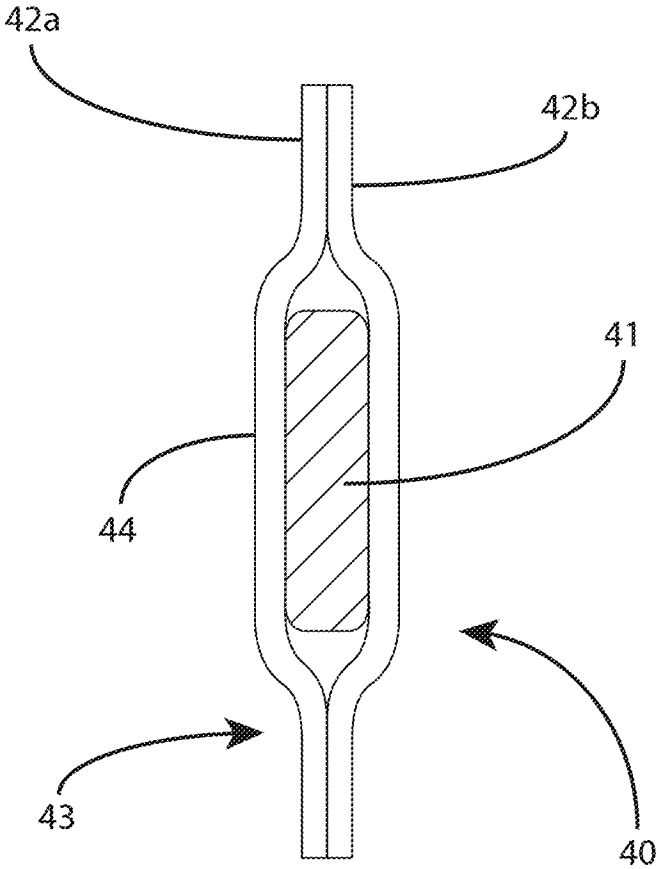
FIG. 5D is a cross-sectional view of the assembled bottom or intermediate layer of FIG. 5C, according to an embodiment.
Figure 5C:
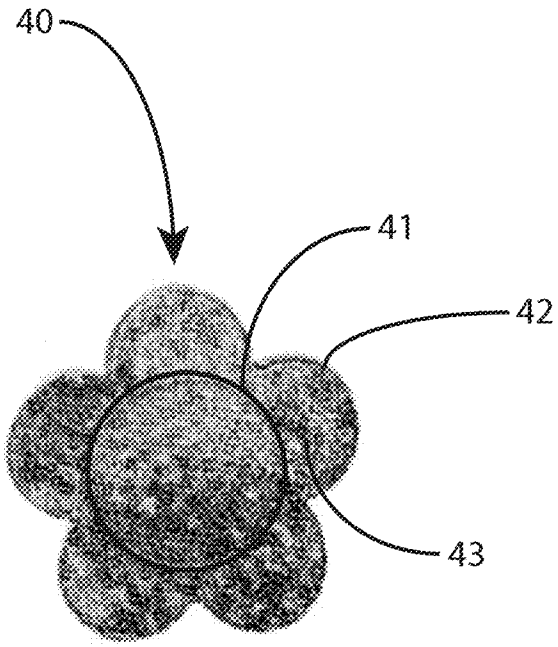
FIG. 5C shows an assembled bottom or intermediate layer having a magnetic member encased by cover layers, according to an embodiment.

As shown in FIGS. 5A-5B, the gripping portion 43 and the cover layer 42 can be made of a single uniform material or, if desired, can be made of distinct materials having different properties or compositions. According to one embodiment, the cover layer 42 may optionally be formed of a top cover layer 42*a* and bottom cover layer 42*b*, each having a central portion 44 for receiving a second magnetic member 41 therein. As shown in cross-section in FIG. 5D, in such an embodiment, the first cover layer 42*a* is secured to the second cover layer 42*b* by an adhesive, a heat weld, or other suitable bonding means. The magnetic member 41 may be affixed within the cover layer 42 or may free-float in the space formed between the two cover layers 42*a*, 42*b*. As an added benefit, when the second magnetic member 41 is provided with a cover layer 42 formed to encapsulate the magnetic member 41, if a magnetic member 41 is dropped or impacted such that it breaks, the cover layer 42 contains the pieces while still functioning to maintain the assembly 100 on the item 30

The cover layer 42 can be made of a non-polymeric material or polymeric material such as rubber, plastic, a thermoplastic elastomer. Alternatively the cover layer 42 may be made of a plain or patterned fabric, which can also function as a complimentary decorative element. In an exemplary embodiment the cover layer is made of polyvinyl chloride (PVC). However, any appropriate material suitable for encasing a magnetic or metallic material therein may be used alone or in combination, including encasing a magnetic member in a layer of metal which does not interfere with the magnetic force of the magnetic member. The cover layer 42 may be formed by a lamination process, vacuum formation, heat shrinking, adhering two disparate film plies, heat sealing, heat shrinking, or any other suitable process. The cover layer 42 may form a water-tight enclosure for the second magnetic member 41, and thus reduce the chance of the magnetic member corroding when exposed to water. This advantageously enables the assembly to remain usable through many different environments which could expose it to water (such as when the assembly is caught in the rain, or when the assembly is inadvertently washed while still attached to a wearable item 30).

Preferably, cover layer 42 is made of a material which is comfortable against the skin, does not have sharp edges or textures, and can also provide a layer of insulation between the user and the second magnetic member 41. When applied to commercial item such as on a sign, automobile, or display window, these properties of the cover layer 42 can also reduce the risk of the magnetic adornment assembly 100 scratching or further damaging the surface of the item 30.

It is noted that although described above and depicted in FIG. 5 as having a cover layer 42, a cover layer is not required if the second magnetic member is not provided with a cover layer 42, the exposed magnetic material may alternatively be provided with a protective layer, such as a layer of paint, lacquer or sealant, a patterned or textured layer, or a material which can provide waterproofing or water resistance. Alternatively, instead of providing a cover layer as described above, the second magnetic member 41 may be provided with a magnetic pole piece shaped such that the magnetic member 41 can be seated within the pole piece (e.g., for a circular magnetic member the pole piece may have a circular shape with an indentation for receiving the magnet therein). The pole piece functions to contain and/or focus the magnetic force in a particular direction, such as toward the top member 10, in order to effect a stronger attractive force. The material and design of the magnetic pole piece is chosen to suit the particular implementation.

In use, as shown in FIGS. 1-3, the magnetic adornment assembly 100 is completed when a top member 10 is placed on one side of an item 30, generally an exterior or viewable side of the item. As depicted generally in FIG. 3, the bottom member 40 is then placed on an opposite side of the item 30 and aligned with the top member 10. Upon alignment of the top member 10 and bottom member 40, the first and second magnetic members 11, 41 are placed proximate to one another such that the magnetic attraction between the two engagement members is achieved. Upon engagement of the second magnetic member 41 and first magnetic member 11, the magnetic adornment assembly 100 in its simplest form is complete. The decoration layer 13 is held in place for display on an exterior so that it is viewable, and therefore may be used to aesthetically enhance or update the item.

To remove the assembly 100, the top member 10 and bottom member 40 are separately grasped by the user. The size and shape of the top member 10 and bottom member 40 are selected such they can generally be grasped by using two fingers such as in a pincer grasp. In some embodiments, the user may grasp the bottom member 40 by the gripping portion 43 of the cover layer 42. This allows the user to use one hand to hold the top member 10 and another to hold the bottom member 40. After grabbing the respective members, the user need only provide a sliding force the top member 10 and the bottom member 40 in opposing lateral direction with respect to each other in order to magnetically decouple the top member 10 from the bottom member 40 (wherein "lateral" is used to generally refer to relative motion orthogonal to the direction of magnetic poles of the magnetic members 11 and 41, and thus generally orthogonal to the contact surface of the item 30). It is noted that the lateral force required to slidingly separate the first and second magnetic members 11 and 41 is typically a fraction of the attractive force the magnetic members exert on one another when concentrically aligned. Accordingly, secure attachment of the assembly 100 to the item 30 is achievable using strong magnetic members, while enabling the easy removal of magnetic adornment assembly when desired.

Figures 4A, 4B, 4C, 4D, 4E, 4F:
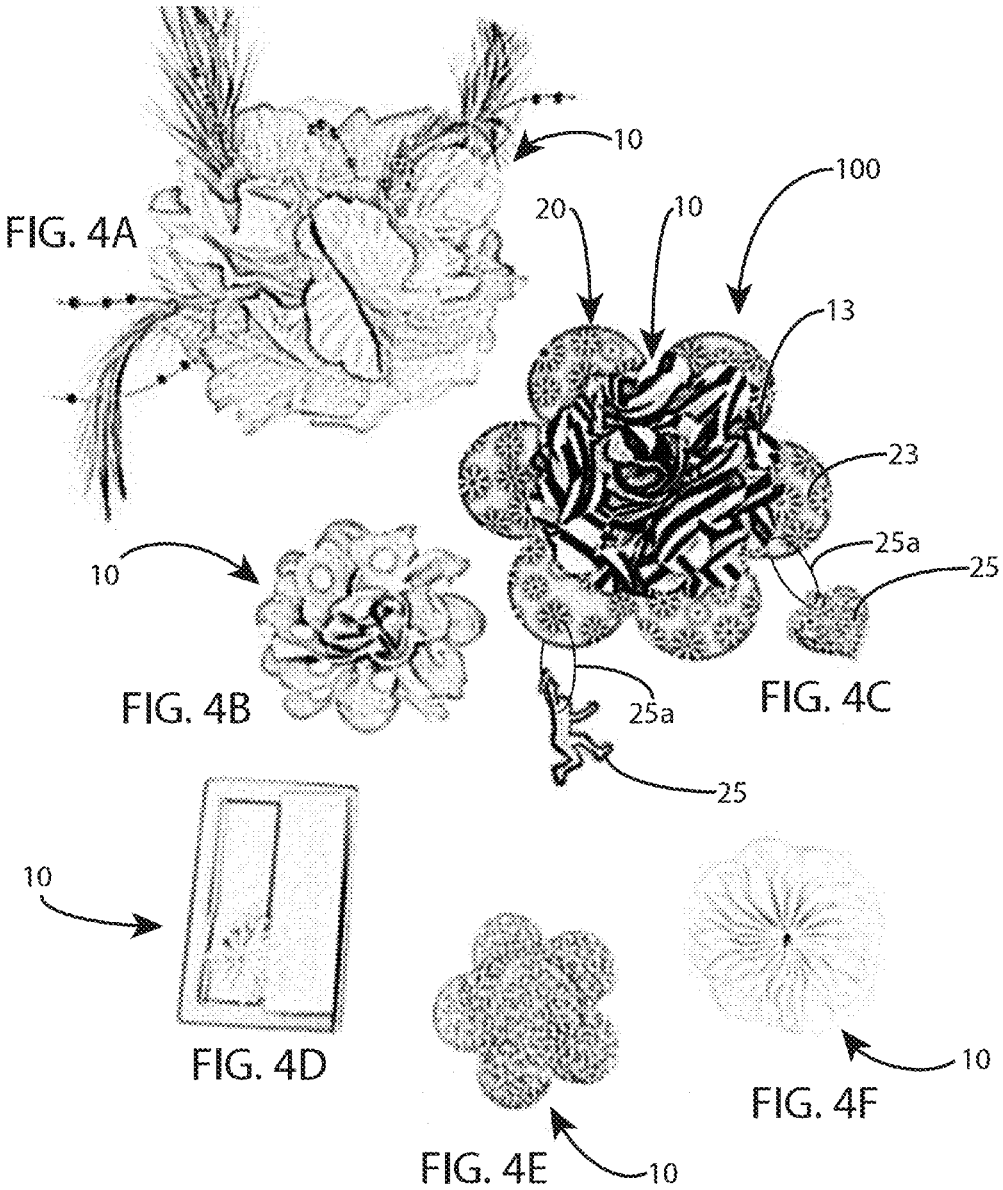
FIGS. 4A-4B show exemplary embodiments of the decorative top member of FIGS. 1-3.
FIG. 4C shows another exemplary embodiment having a decorative top member provided with a visible intermediate decorating layer.
FIGS. 4D-4F shows further exemplary embodiments of the decorative top member.

In some embodiments, as depicted in FIGS. 2 and 4C, the top member 10 and bottom member 40 may further have one or more intermediate layers 20 provided therebetween. Though not required, the intermediate layer(s) 20 may optionally be provided with an intermediate magnetic member 21 which constructively interacts with first and second magnetic members 11 and 41.

In addition to or in place of an intermediate magnetic member 21, the intermediate layer 20 may be provided with an intermediate decoration layer 23. The intermediate decoration layer 23 may be selected to enhance and compliment the ornamental nature of the top decoration layer 13, such as having an aesthetically contrasting or matching texture, pattern, or color which makes the decoration layer 13 visually stand out when concentrically layered, an example of which is shown in FIG. 4C where the intermediate layer 20 has a decoration layer 23 formed thereon which is viewable from behind the decoration layer 13 of the top member 10. Alternatively the intermediate decoration layer 23 can be provided as a neutral, non-distracting background to the decorative layer 13 of the top member 10. Further, more than one intermediate layer 20 may be provided between top member 10 and bottom member 40, and in this way the magnetic adornment assembly 100 can be layered in many different ways in order to suit the user's individual fashion, creativity, and/or intended purpose.

Further, the decoration layer 23 of the intermediate member 20 and/or the decoration layer 13 of the top member 10 may optionally have at least one charm 25 hanging from a decoration layer by charm attachment means 25*a*. For example, in FIG. 4C, charms 25 are attached to intermediate decoration layer 23 via charm attachment means 25*a*. The charms may be any shape or size and may be attached to the corresponding decoration layer using adhesive, stitching, pins, a small hoop or chain, or any other suitable means for securing charms 25 to the corresponding decoration layer 13,23. While the charm 25 is depicted in FIG. 4C as attaching to the decoration layer, the charm 25 may alternatively be attached to any other portion of the top member 10 or intermediate member 20, and is not limited to attaching to a decoration layer.

The size and shape of the intermediate decoration layer 23 can be chosen to correspond to the size and shape of the decoration layer 13, or may also be chosen to correspond to size and shape of the undesired feature or blemish to be covered up (e.g., a unusually shaped stain or tear). Alternatively, the intermediate decoration layer 23 may provide additional or complimentary information such as a company, team, or person's name or logo. Further, in an embodiment having an intermediate magnetic member 21, the intermediate decoration layer 23 may also function as an intermediate gripping portion for enabling removal of the concentrically layered top assembly (which consists of the top member 10 and the at least one intermediate member(s) 20).

In some embodiments, the at least one intermediate layer 20 is provided with an intermediate magnetic member 21 for cooperating with the first and second magnetic members 11 and 41 to enhance the attractive force therebetween. This is particularly advantageous when the item 30 is made of a thicker or denser material, where the magnetic attractive force of the first and second magnetic members alone may be not strong enough to hold the magnetic adornment assembly 100 to the item 30. When an intermediate magnetic member 21 is provided, additional holding force is provided by the combined magnetic attractive forces of the first, intermediate, and second magnetic members 11, 21, and 41, respectively. As is well-known, the poles of the first, intermediate, and second magnetic members must be aligned to achieve this aggregate magnetic force. As a result of this successive concentric layering, the magnetic adornment assembly can be fixedly retained to the item 30 even if the item 30 is constructed of a thicker material (e.g., leather, insulated fabric, canvas, cardboard, etc.). The additional holding force may also be desirable if the decoration layer 13 or top member 10 as a whole is made of a larger, denser, or heavier material or design.

When one or more intermediate layers 20 are provided, removal of the concentrically layered adornment assembly is performed in substantially the same way as discussed above. To remove the assembly, a user grasps the intermediate member 20 (or alternately grasp top member 10) and using another hand grasps the bottom member 40. Once gripped, the user applies a generally opposing lateral motion between the intermediate and bottom members in order to slide the second magnetic member 41 out of concentric alignment with the intermediate and first magnetic members 21 and 11. As a result, the net magnetic attractive force between the top, bottom, and intermediate member(s) is substantially reduced or eliminated and the two pieces can be easily removed from the item 30. Though depicted as being disposed on an outer, viewable side of the item 30, the intermediate layer(s) 20 may also optionally be provided on either an interior or exterior side of the item 30, or concentrically layered on one or both sides simultaneously.

As is clear from the discussion above, the magnetic adornment assembly 100 has many customizable features which enable personal creativity and preferences to be expressed and updated. The bottom member 40 is generally compatible with any style of top members 10, whether layered with one or more intermediate layers 20 or without, such that top members having decoration layers 13 with a variety of designs and sizes can be used with the same bottom member 40. Accordingly, a user may quickly and efficiently switch top members 10 to match a particular mood, theme, or purpose. As a result of the magnetic adornment assembly disclosed herein, an item 30 has gone from general disuse to being usable and appropriate for a variety of occasions from personal to professional.

The above specification, examples and data provide a complete description of the structure and use of exemplary embodiments of the invention as defined in the claims. Although various embodiments of the claimed invention have been described above with a certain degree of particularity, or with reference to one or more individual embodiments, those skilled in the art could make numerous alterations to the disclosed embodiments without departing from the spirit or scope of the claimed invention. Other embodiments are therefore contemplated. It is intended that all matter contained in the above description and shown in the accompanying drawings shall be interpreted as illustrative only of particular embodiments and not limiting. Changes in detail or structure may be made without departing from the basic elements of the invention as defined in the following claims.

What is claimed is:

1. An apparatus for improving the aesthetic appeal of an item, the apparatus comprising an outer assembly having at least a first magnetic engagement member and at least one decorative element;

an inner assembly having a second magnetic engagement member having a top surface, a bottom surface, and a perimeter edge defined between the top surface and the bottom surface;

a cover layer provided on the second magnetic engagement member and having a flange portion coplanar with and extending beyond an entirety of the perimeter edge of the second magnetic engagement member configured to be simultaneously grasped on opposing sides of the flange portion when the apparatus is coupled to the item;

wherein when the item is positioned between the outer assembly and the inner assembly, the first magnetic engagement member is operable to attract the second magnetic engagement member, thereby coupling the outer assembly to the inner assembly with the item in between.

2. The apparatus according to claim 1, wherein the first magnetic engagement member and the second magnetic engagement member are reversibly coupled upon concentric alignment.

3. The apparatus according to claim 1, wherein the cover layer encapsulates the second magnetic engagement member.

4. The apparatus of claim 3, wherein the cover layer forms a water-tight enclosure around the second magnetic member.

5. The apparatus of claim 3, wherein the flange portion and the second magnetic engagement member are coplanar.

6. The apparatus of claim 3 wherein the cover layer is sized and shaped to avoid swallowing and reduce a risk as a choking hazard for small children.

7. The apparatus of claim 1, wherein the second magnetic member is secured to the cover layer.

8. The apparatus according to claim 1, further comprising at least one intermediate member that is not the item positioned between the outer assembly and inner assembly.

9. The apparatus according to claim 8, wherein the at least one intermediate member comprises at least one display layer.

10. The apparatus according to claim 8, wherein the at least one intermediate member is placed proximate to the outer assembly.

11. The apparatus according to claim 10, wherein the at least one intermediate member comprises a mechanism configured to hang charms therefrom.

12. The apparatus according to claim 10, wherein the at least one intermediate member has a perimeter that is larger than a perimeter of the outer assembly.

13. The apparatus according to claim 1, wherein at least one of the first magnetic engagement member and second magnetic engagement member comprise a magnet.

14. The apparatus according to claim 13, wherein the other of the first magnetic engagement member and second magnetic engagement member comprise a magnetically compatible material.

15. The apparatus according to claim 14, wherein the magnetically compatible material is a material which is attracted to a magnet, wherein the material is one of a magnetizable metal, iron, or a magnet.

16. The apparatus according to claim 1, wherein the flange portion is flexible.

17. The apparatus according to claim 16, wherein the flange portion is coplanar with a plane extending between the top surface and the bottom surface of the second magnetic engagement member.

18. The apparatus of claim 1, wherein at least one dimension of the inner assembly is at least 1.25 inches.

19. An apparatus for improving the aesthetic appeal of an item, the apparatus comprising an outer assembly having at least a first magnetic engagement member configured to receive at least one decorative element;

an inner assembly having a second magnetic engagement member having a top surface, a bottom surface, and a perimeter edge defined between the top surface and the bottom surface;

a cover layer provided on the second magnetic engagement member and having a flange portion coplanar with and extending beyond an entirety of the perimeter edge of the second magnetic engagement member configured to be simultaneously grasped on opposing sides of the flange portion when the apparatus is coupled to the item;

wherein when the item is positioned between the outer assembly and the inner assembly, the first magnetic engagement member is operable to attract the second magnetic engagement member, thereby coupling the outer assembly to the inner assembly.

20. A kit containing elements for an apparatus for improving the aesthetic appeal of an item, the kit comprising an outer assembly member having at least a first magnetic engagement member configured to receive at least one decorative element;

at least one decorative element;

an inner assembly member having a second magnetic engagement member and a cover layer; wherein the second magnetic member has a top surface, a bottom surface, and a perimeter edge defined between the top surface and the bottom surface;

the cover layer encapsulates the second magnetic engagement member and comprises a flange portion extending beyond an entirety of the perimeter edge of the second magnetic engagement member;

the flange portion is configured to be simultaneously grasped on opposing sides to position the inner assembly when coupling the apparatus to the item and decoupling the apparatus from the item; and when the outer assembly member and the inner assembly member are configured to be positioned adjacent to an item such that the first magnetic engagement member is operable to attract the second magnetic engagement member, thereby coupling the outer assembly member to the inner assembly member through the item.

21. An apparatus for improving the aesthetic appeal of an item, the apparatus comprising an outer assembly having at least a first magnetic engagement member configured to receive at least one decorative element;

an inner assembly having a second magnetic engagement member having a top surface, a bottom surface, and a perimeter edge defined between the top surface and the bottom surface; and a cover layer encapsulating the second magnetic engagement member to form a water-tight enclosure around the second magnetic member and having a flexible flange portion extending beyond an entirety of the perimeter edge of the second magnetic engagement member and further configured to be simultaneously grasped on opposing sides of the flange portion when the apparatus is coupled to the item;

wherein when the item is positioned between the outer assembly and the inner assembly, the first magnetic engagement member is operable to attract the second magnetic engagement member, thereby coupling the outer assembly to the inner assembly.

* * * * *